United States Patent [19]

Nakamura et al.

[11] Patent Number: 4,987,399

[45] Date of Patent: Jan. 22, 1991

[54] ELECTRIC COIL ASSEMBLY

[75] Inventors: Mamoru Nakamura; Hideya Hori, both of Aichi, Japan

[73] Assignee: Aisin Seiki Kabushiki Kaisha, Kariya, Japan

[21] Appl. No.: 415,752

[22] Filed: Oct. 2, 1989

[30] Foreign Application Priority Data

Sep. 30, 1988 [JP] Japan ..... 63-128556[U]

[51] Int. Cl.[5] ..... H01F 15/10

[52] U.S. Cl. ..... 336/192; 310/71; 336/208

[58] Field of Search ..... 192/84 R, 84 B; 310/71, 310/194, 237; 336/192, 198, 208, 107

[56] References Cited

U.S. PATENT DOCUMENTS

| | | | |
|---|---|---|---|
| 2,238,740 | 4/1941 | Lazich | 336/107 |
| 2,544,508 | 3/1951 | Mackey | 336/198 X |
| 3,979,707 | 9/1976 | Prince, Jr. | 336/198 X |

FOREIGN PATENT DOCUMENTS

| | | | |
|---|---|---|---|
| 235292 | 6/1925 | United Kingdom | 336/192 |

OTHER PUBLICATIONS

"Attachment of Coil Leads to Bobbins," Darwin, IBM Technical Disclosure Bulletin, vol. 19, No. 7, Dec. 1976, p. 2414.

*Primary Examiner*—Thomas J. Kozma

*Attorney, Agent, or Firm*—Sughrue, Mion, Zinn, Macpeak & Seas

[57] ABSTRACT

An electric coil assembly is formed from an annular bobbin having a circumferential channel formed therein for receiving an electrically conductive coil. A pair of raised portions are integrally formed on one side of the bobbin and a pair of terminals are embedded in the raised portions. Each terminal is in the form of a U-shaped member having opposite ends protruding from the raised portion for connection with one end of respective spring strips which are mounted on said raised portions, the opposite ends of which are adapted to be slidably engaged with electric current supply members.

2 Claims, 4 Drawing Sheets

ELECTRIC COIL ASSEMBLY

BACKGROUND OF THE INVENTION

Field Of The Invention

The present invention is directed to an electric coil assembly and more particularly to an improved terminal structure to which the ends of the wires of the electric coil are connected for receiving current from a suitable power supply.

Electromagnetic coil assemblies such as those used with electromagnetic clutches or electromagnetic sensors are basically provided with an electrically conductive wire coil wound on a bobbin and connected to an electrical terminal The coil bobbin generally has a concave portion in one surface thereof in which the electrically conductive wire is wound to form a coil. The electrical terminal is usually formed of one piece construction with the bobbin and terminal poles are embedded in the bobbin. One end of the wire coil would be connected to an input terminal and the other end of the wire coil would be connected to an output terminal and input and output wires would also be connected to the input and output terminals respectively.

In this type of well known electromagnetic coil assembly the ends of the wire coil and the input and output wires are connected to the terminal individually thereby providing a complicated electrical connecting structure which lacks stability and which is time consuming to assemble.

SUMMARY OF THE INVENTION

The present invention provides a new and improved electric coil assembly which obviates the aforementioned problems and provides a terminal portion with improved reliability, strength and efficiency in operation.

In order to achieve the foregoing objects, and in accordance with the principles of the present invention, the electric coil assembly is comprised of a bobbin, an electrical coil wound on said bobbin, an electrical terminal portion disposed on a surface of the bobbin, electrical means associated with said terminal and slidable switching means connected with said electrical connecting means.

Other objects, features and advantages of the present invention will become more apparent from the following detailed description of the invention when considered in conjunction with the accompanying drawings.

Detailed Description Of The Invention

Figure 1:
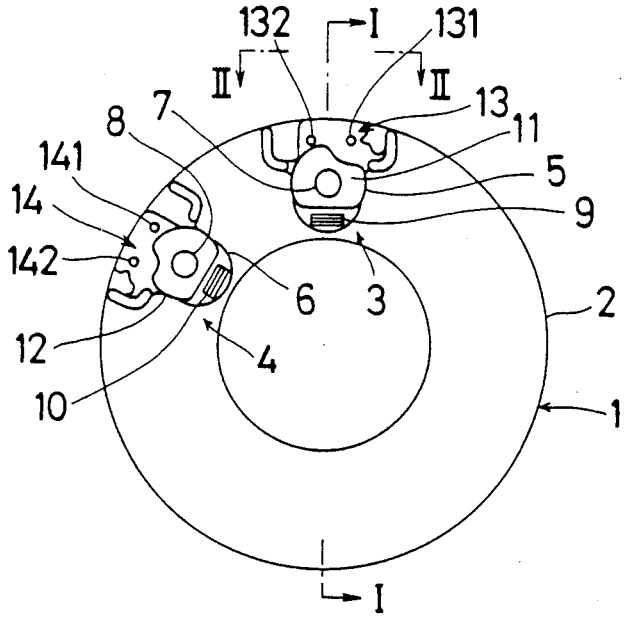
FIG. 1 is a front elevation view of an electric coil assembly usable with an electromagnetic clutch.
Figure 2:
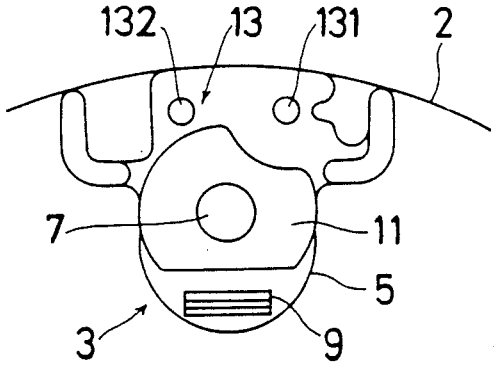
FIG. 2 is a partially enlarged view of the terminal portion shown in FIG. 1.
Figure 3:
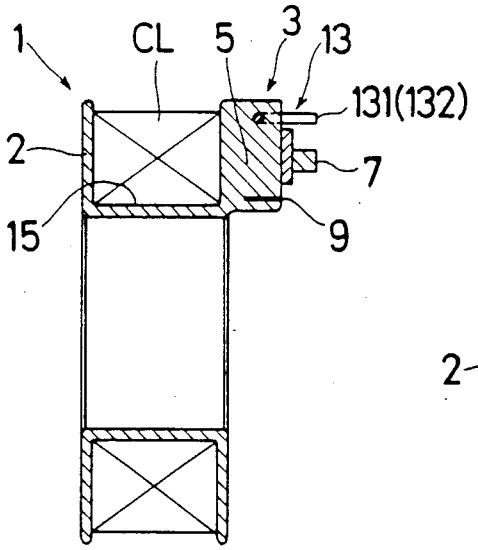
FIG. 3 is a cross-sectional view taken along the line I—I in FIG. 1.
Figure 4:
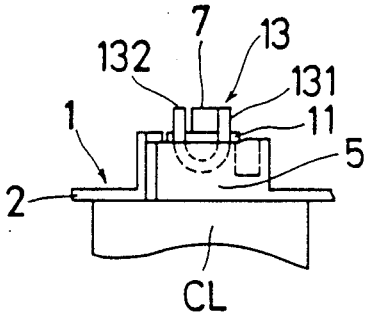
FIG. 4. is a partial side view of the assembly shown in FIG. 1 as viewed along the line II—II.
Figure 5:
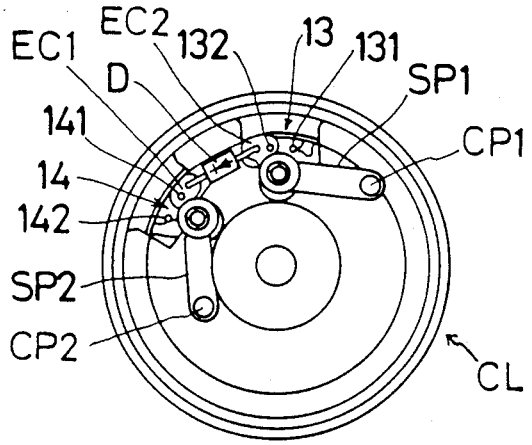
FIG. 5 is a view similar to FIG. 1 with electrical connectors connected to the terminals.
Figure 6:
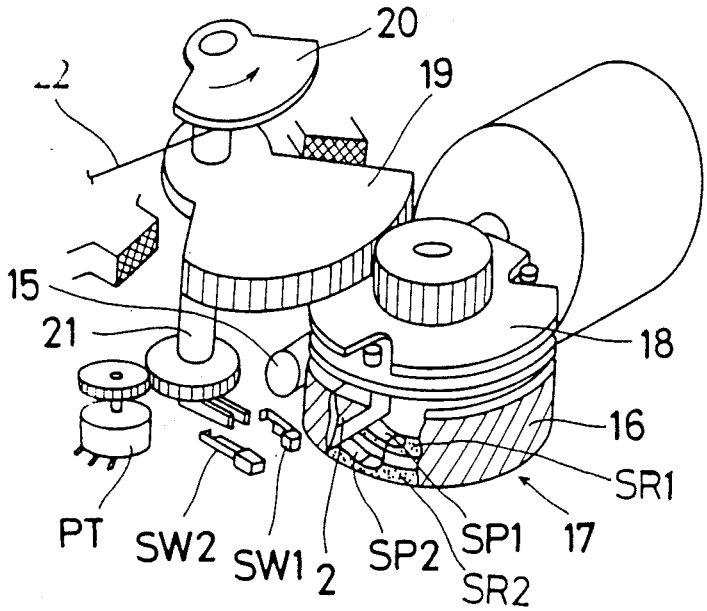
FIG. 6 is an enlarged partial view of a connection.
Figure 6:
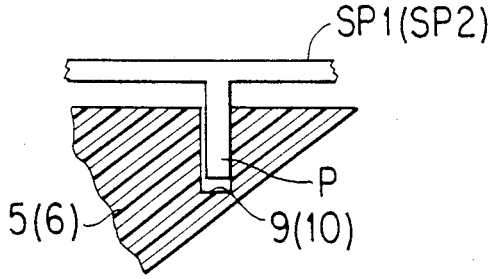

Referring to FIGS. 1–6, an electric coil assembly includes a bobbin 2 having a pair of electric terminal portions 3 and 4 thereon. The bobbin 2 is formed in a ring-shaped configuration and is provided with a concave channel 15 in which a coil CL of electrically conductive wire has been wound, as best seen in FIG. 3. The bobbin 2 is provided with integral raised portions 5 and 6 having smaller projections 7 and 8 protruding therefrom. The raised portions 5 and 6 have slits 9 and 10 for the reception of connecting plate springs. A pair of stabilizing plates 11 and 12 are connected to the projections 7 and 8 respectively. A U-shaped terminal 13 is embedded in the raised portion 5 and a U-shaped terminal 14 is embedded in the raised portion 6. The terminal 13 has two protruding ends or pole portions 131 and 132 and the terminal 14 has two protruding ends or pole portions 141 and 142. One end of the coil CL formed on the bobbin is electrically connected to one of the pole portions 131, 132 of the terminal 13 by soldering or other suitable means. The opposite end of the coil is electrically connected to one of the pole portions 141, 142 of the terminal 14 in a similar manner.

Figure 7:
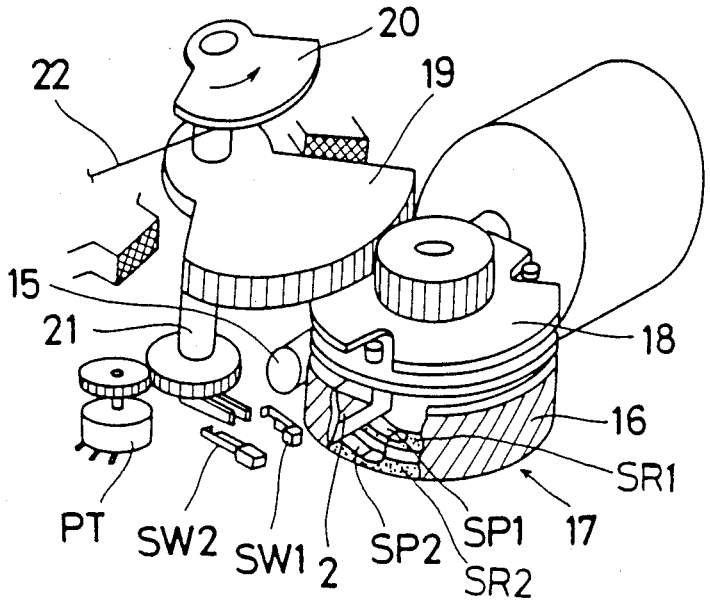
FIG. 7 is a perspective view, partially broken away, of a reduction gear assembly using the coil assembly.

The stabilizing plates 11 and 12 are rotatably mounted on the projections 7 and 8. A plate spring SP1 is connected at one end to the projection 7 of the raised portion 5 and is provided with a projection P (FIG. 6) which extends into the slit 9 in the raised portion. An electrically conductive plate EC1 is arranged between the projection 7 and the terminal 13 and electrically connects the spring plate SP1 to the terminal 13. The opposite end of the plate spring SP1 is provided with a contact point CP1 which is adapted to engage an electrically conductive strip 25 formed on a suitable substrate below the bobbin as best seen in FIG. 7. A second spring plate SP2 is connected at one end to the projection 8 on the raised portion 6 and is provided with a projection P (FIG. 6) which is operatively connected in the slit 10 in the raised portion 6. An electrically conductive plate EC2 is arranged between the projection 8 and the terminal 14 and electrically connects the spring plate SP2 to the terminal 14. The opposite end of the plate spring SP2 is provided with a contact point CP2 that may be disposed in sliding engagement with an electrically conductive strip 27 formed on the same substrate with the strip 25 as seen in FIG. 7. A diode D is connected between the plate EC1 and EC2.

The electric coil assembly disclosed in FIGS. 1–6 may be incorporated into an electromagnetic clutch assembly as illustrated in FIG. 7. The drive shaft 15 of an electric motor M is formed with threads disposed in meshing engagement with worm wheel 16 which is the driving gear of an electromagnetic clutch assembly 17. The pinion gear 18 constitutes the driven clutch member of the electromagnetic clutch assembly 17 and is disposed in meshing engagement with the gear 19 secured to the shaft 21. An arm 20 is also secured to the shaft 21 and may be operatively connected to the throttle valve of an internal combustion engine as is well known in the art. A potentiameter PT and limit switches SW1 and SW2 provided adjacent the opposite end of the shaft 21 for operatively controlling the motor M and the throttle valve as is well known in the art. The electric coil assembly 2 is disposed within the worm wheel 16 and the plate springs SP1 and SP2 are shown with their contact points CP1 and CP2 disposed in sliding engagement with the electrically conductive strips 25 and 27 which are concentrically formed on the substrate (not shown). The electrically conductive strips 25 and 27 may be connected to a suitable current supply and the current is transmitted to the coil CL of the coil assembly by the terminal arrangement disclosed above.

The foregoing invention has been described in an illustrative manner and it is to be understood that the terminology used therein is intended to be in the nature of words of description rather than of limitation. Obviously, many modifications and variations of the present invention are possible in light of the teachings. It is therefore to be understood that within the scope of the pending claims the invention may be practiced otherwise than as specifically described.

What is claimed is:

1. An electric coil assembly comprising a bobbin, a coil of electrically conductive wire wound on said bobbin, electric terminal means disposed on one side of said bobbin, means for electrically connecting opposite ends of said coil to said terminal means and electrically conductive spring means operatively connected to said terminal means and arranged for sliding contact with electrically conductive strips on a substrate for transferring current from said strips to said coil, wherein said terminal means is comprised of a pair of U-shaped electrically conductive terminals embedded in said bobbin with each terminal having a pair of projecting pole portions and said opposite ends of said coil are connected to one pole of each pair of pole portions, respectively.

2. An electric coil assembly as set forth in claim 1, further comprising means on said bobbin for operatively supporting one end of each of said spring means in electrical engagement with said pole portions.

* * * * *